US005743726A

United States Patent [19]

Werding

[11] Patent Number: 5,743,726

[45] Date of Patent: Apr. 28, 1998

[54] APPARATUS FOR THE VAPORIZATION OF FUELS AND SUPPLY OF AIR FOR COMBUSTION

[76] Inventor: Winfried Werding, 2, rue du carroz, La Rippe, Switzerland

[21] Appl. No.: 507,254

[22] PCT Filed: Feb. 17, 1994

[86] PCT No.: PCT/IB94/00015

§ 371 Date: Aug. 21, 1995

§ 102(e) Date: Aug. 21, 1995

[87] PCT Pub. No.: WO94/19648

PCT Pub. Date: Sep. 1, 1994

[30] Foreign Application Priority Data

Feb. 19, 1993 [CH] Switzerland ..... 514/93

[51] Int. Cl.[6] ..... F23L 17/00

[52] U.S. Cl. ..... 431/157; 431/176; 431/181; 431/243

[58] Field of Search ..... 431/243, 12, 89, 431/157, 158, 176, 181

[56] References Cited

U.S. PATENT DOCUMENTS

| | | | |
|---|---|---|---|
| 5,125,828 | 6/1992 | Browning | 431/157 X |
| 5,263,849 | 11/1993 | Irwin et al. | 431/10 X |

FOREIGN PATENT DOCUMENTS

| | | | |
|---|---|---|---|
| 353 931 | 12/1979 | Austria . | |
| 0 436 113 | 7/1991 | European Pat. Off. . | |
| 809455 | 3/1937 | France . | |
| 855474 | 5/1940 | France . | |
| 903293 | 9/1945 | France . | |
| 2 262 775 | 9/1975 | France . | |
| 775518 | 11/1980 | U.S.S.R. | 431/181 |
| 1364750 | 8/1974 | United Kingdom | 431/181 |

*Primary Examiner*—Larry Jones
*Attorney, Agent, or Firm*—Young & Thompson

[57] ABSTRACT

Fuel is fed by a feeding pump to a pressurized container. A predetermined amount of fuel is kept constant in the container by a floater which carries a needle for opening and closing a return as required. In the pressurized container the fuel is kept by a compressor under compressed air pressure which may be regulated by a pressure control valve, so that when the valve is opened fuel and air both under the same pressure are pressed into a nozzle unit in which air is highly pressed in the fuel so that when it leaves the nozzle channel it expands in an explosive manner and bursts the fuel into fine droplets. Secondary combustion air from an air generator is blown into the flame perpendicularly to the axis of the flame and fed to the fuel-air mixture.

14 Claims, 5 Drawing Sheets

APPARATUS FOR THE VAPORIZATION OF FUELS AND SUPPLY OF AIR FOR COMBUSTION

BACKGROUND OF THE INVENTION

Object of the present invention is an apparatus for the vaporization of fuels comprising a nozzle unit supplied via a fuel pump and fuel supply line with fuel and, separately, via an air generator and air supply line with air, said nozzle unit having a longitudinal axis and a chamber mounted perpendicularly to said axis into which the fuel and air are conveyed for mixing via supply lines, the supply lines for the fuel opening tangentially into the chamber so that the fuel in the chamber is set in whirling motion occurring substantially in a direction perpendicular to the longitudinal axis, and the mixture being discharged via a nozzle channel.

The combustion of organic matter such as fuel oil gives rise to the formation of residues such as carbon monoxide (CO), which burns to carbon dioxide ($CO_2$), hydrogen, which is oxidized to water vapor, and nitrogen monoxide (NO), which with air oxygen is oxidized to $NO_2$, together known as $NO_x$.

Apart from the hydrocarbons and other ingredients, fuel oils contain chlorine and sulfur, the share of the latter being higher the heavier the fuel oil and attaining up to 3.5% by weight.

The main problem of present heating installations is that of particle size of the atomized fuel oil, which to the extent of 80% is between 40 and 80 microns when an atomizing pressure of about 15 bars is used.

For optimum combustion the relatively large droplets are maintained in suspension by means of a blower until they have completely burned, but this leads to oversized combustion chambers, on one hand, and to overly large air volumes per kilogram of the fuel oil, on the other hand.

Particularly in the case of industrial oil burners, good combustion is difficult to attain since the known mechanical spray diffusers, with the heavy fuel oils used here, lead to a particle size of at least 60 microns even at high pressures, of over 20 bars. In addition, very small nozzle openings are required here, with a diameter of about 0.15 mm, which readily clog and cause breakdowns.

The heavy fuel oils are heated to temperatures of 50° to 100° C. in order to lower their viscosity, which has an effect on particle size, though not enough to bring about an optimum combustion, quite apart from the fact that a large amount of energy is consumed for heating the fuel oil.

The amount of air of combustion which is supplied, but also its pathway within the burner and its temperature are decisive, too, for the combustion process, the amount of air usually being exaggerated and never merely that required stoichiometrically, since with the stoichiometric amount alone the unburned residues would be overly large.

The excessive production of $NO_X$ is a real problem which, when combustion is incomplete, with hydrogen and water vapor leads to the formation of sulfuric, hydrochloric and nitric acid leading to the well-known acid rain.

DESCRIPTION OF THE PRIOR ART

French Patent No. 903 293 describes an apparatus having the characteristics stated in the introduction to claim 1. The apparatus comprises a nozzle unit with concentrically arranged supply lines for fuel and gas opening via tangentially oriented channels into a whirling chamber from which the fuel-gas mixture is discharged via a nozzle channel.

Here, both the gas and fuel are fed tangentially into the chamber, where they are in whirling motion. As the gas and fuel move in the same sense, and more or less parallel one besides the other, this arrangement cannot produce a thorough mixing of fuels and gas, which has a negative effect on particle size at the exit and excludes an optimum combustion.

According to French Patent No. 809 455, the fuel and air are conveyed together to the discharge channel over helicoidal grooves in the nozzle unit. Even here, the mixing of fuel and air is only moderate. Moreover, means are not provided here for producing higher compression of the air in the fuel, which is very important for fuel vaporization.

SUMMARY OF THE INVENTION

The present invention has the objective of obviating the disadvantages of known apparatus, and vaporize rather than atomize the fuels, while attaining the smallest possible particle size.

According to the invention, this objective is attained by an apparatus for the vaporization of fuels and supply of air for combustion as defined in claim 1.

In the apparatus according to the invention, the air used for vaporization thus constitutes part of the air for combustion, while an ultrafine particle size leads to faster vaporization and thus better combustion, so that the formation of undesired residues and particularly of $NO_X$ is limited.

Further advantages will become apparent from the characteristics of dependent claims and from the following description illustrating the invention in detail and with advantageous, though not limiting embodiments with the aid of drawings where

DESCRIPTION OF THE PREFERRED EMBODIMENTS

Fundamentally, the apparatus of the present invention is based on a device for atomization of liquids mixed with compressed gas which, at a pressure of merely 1 bar, gives rise to a Sauter mean particle size of 21.08 microns. Depending on the amount of admixed air and on the cross section of the nozzle opening 9, the particle size can be reduced considerably, so that the operation can be called vaporization.

This vaporization constitutes the basis of the apparatus according to the present invention and guarantees an optimum combustion.

Figure 1:
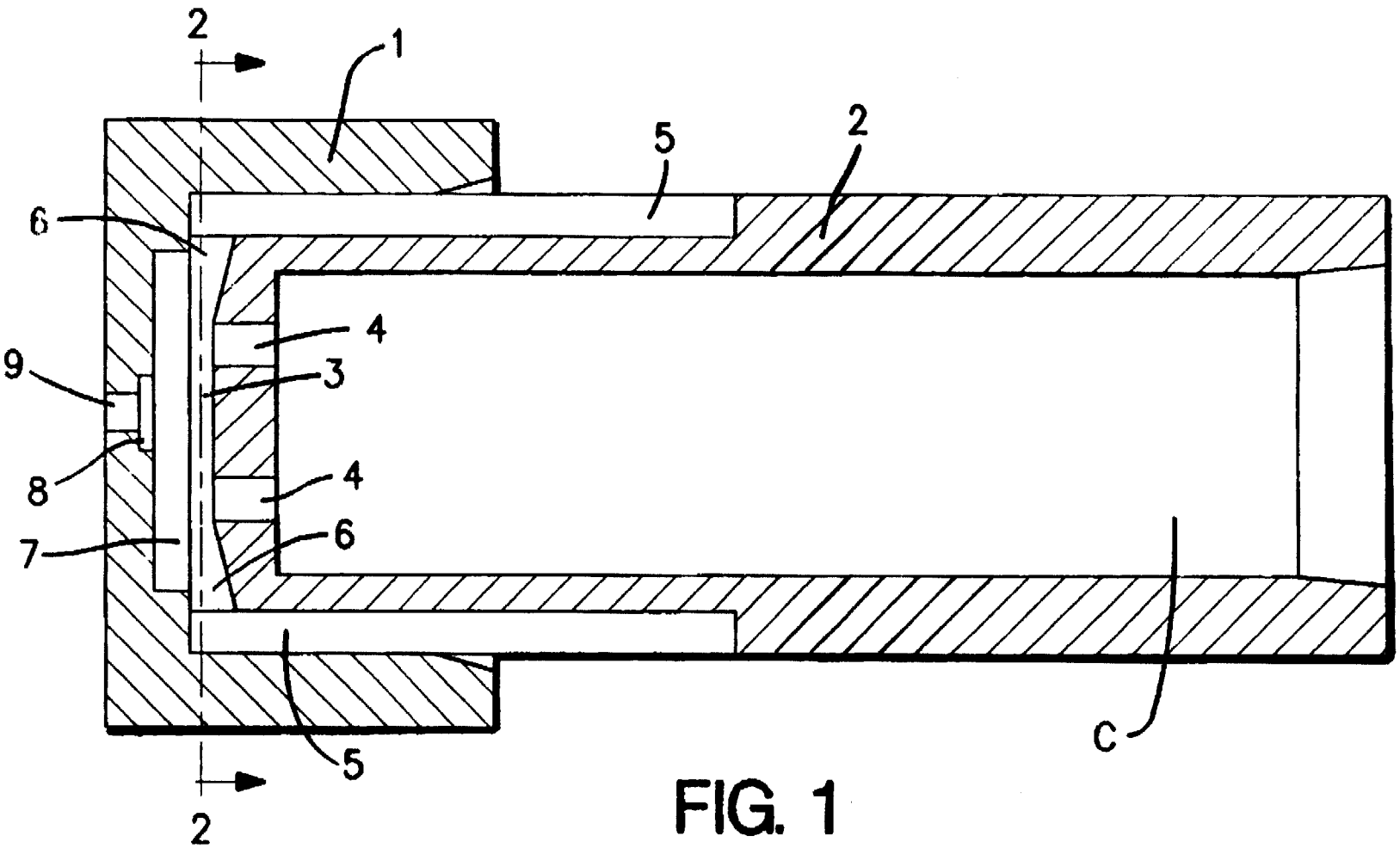
FIG. 1 is a sectional view of a two-component nozzle according to the invention.
Figure 2:
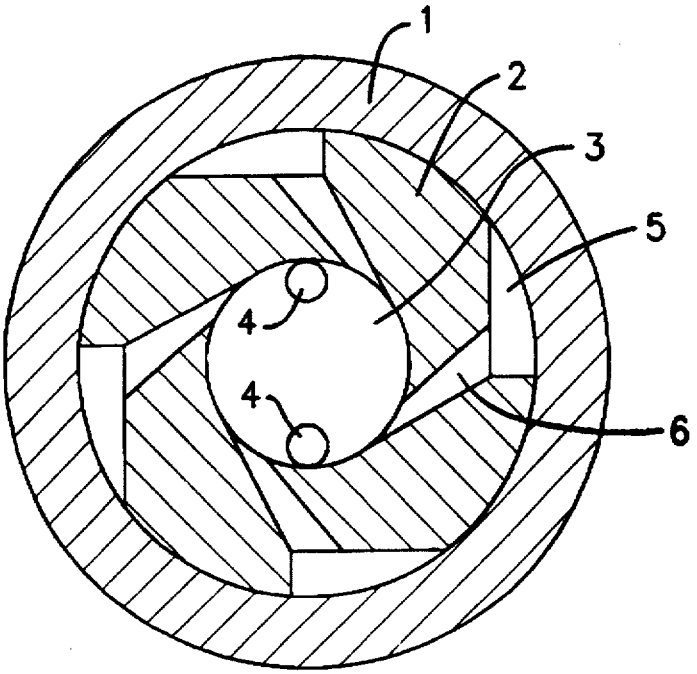
FIG. 2 is a sectional view of a nozzle core along sectional plane 2—2 of FIG. 1.
Figure 3:
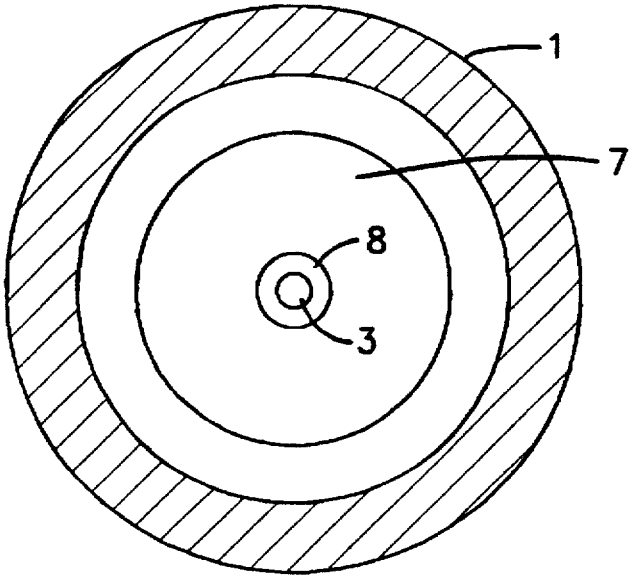
FIG. 3 is a sectional view of a nozzle sleeve along sectional plane 2—2 of FIG. 1.

FIG. 1 shows a nozzle sleeve 1 holding a nozzle core 2 with a mixing chamber 3 receiving compressed air via bores 4 parallel to the core axis and fuel oil under pressure via supply channels 5 and tangential channels 6 (see also FIG. 2) so that the fuel oil and compressed air can mix in it. The nozzle sleeve 1 has an expansion chamber 7, a compression chamber 8, and a nozzle channel 9. The depth of expansion chamber 7 and compression chamber 8 is determining for the length of nozzle channel 9, a short nozzle channel 9 providing a wider cone than a long channel.

Figure 4:
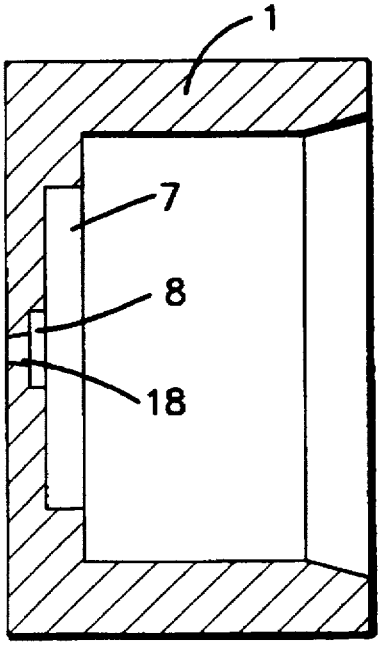
FIG. 4 is a sectional view of a nozzle sleeve according to FIG. 1.

FIG. 4 further shows a conical nozzle channel 10 providing an even wider cone than a nozzle channel 9 that has equal length but is cylindrical. The diameters of nozzle channels 9 and 10 are determining for the amount of fuel oil delivered in unit time; at any given pressure, this delivery is small for low channel diameters, but the diameters of nozzle channels 9 and 10 are not below 0.30 mm, and they remain always permeable, since they can be purged with the air of vaporization.

The supply channels 5 of nozzle core 2 open into the tangential channels 6 which in turn open into the mixing chamber 3, hence a fuel oil coming from the supply channels 5 and tangential channels 6 is injected into the mixing chamber 3 in such a way that it is set in whirling motion along the chamber walls while the compressed air is fed in perpendicularly via bore 4, passes through a first phase of compression in the mixing chamber 3, is allowed to expand in expansion chamber 7, but is then compressed into the fuel oil in compression chamber 8. Therefore, when the fuel oil-air mixture leaves the nozzle sleeve via the nozzle channel 9, the highly compressed air will expand as if exploding when it comes in contact with atmospheric pressure, hence it shatters the fuel oil into minute droplets, which are so much smaller since the fuel oil and air pressure is high; they have a diameter of less than five microns when the working pressure is between three and five bars. In this way the total surface area of the vaporized fuel becomes exceedingly large, and more air oxygen can be taken up for combustion, which leads to better combustion, hence to a better heating value, so that fuel oil is economized, on one hand, and fewer residues are formed, on the other hand.

Figure 5:
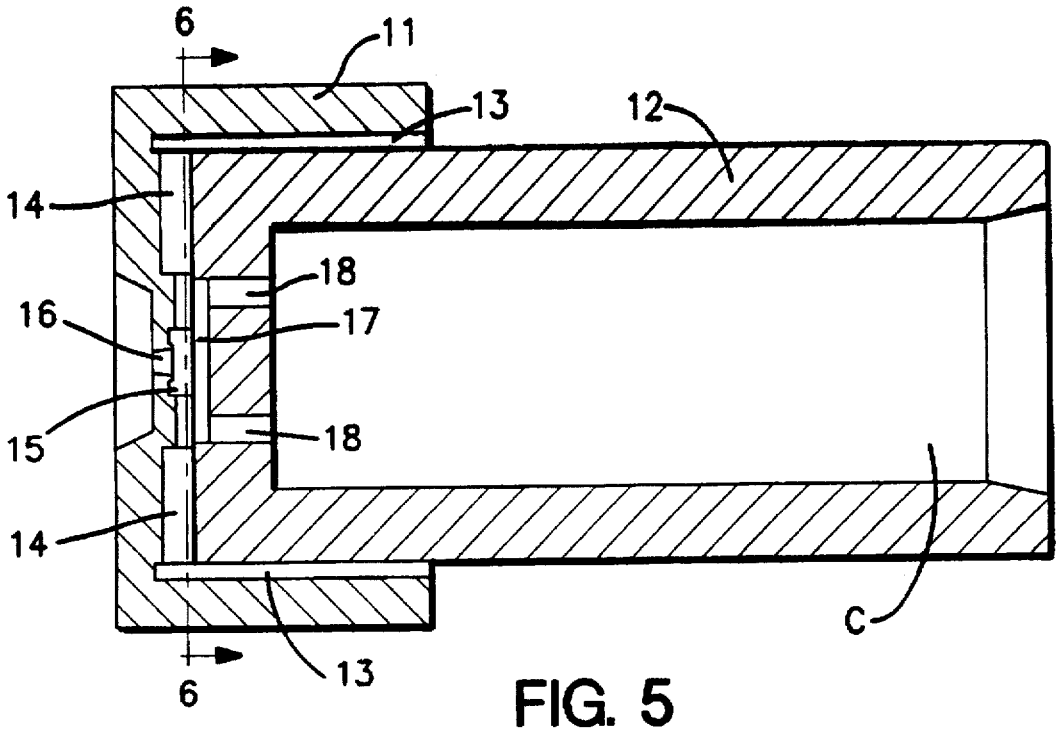
FIG. 5 is a sectional view of another embodiment of a two-component nozzle according to the invention.
Figure 6:
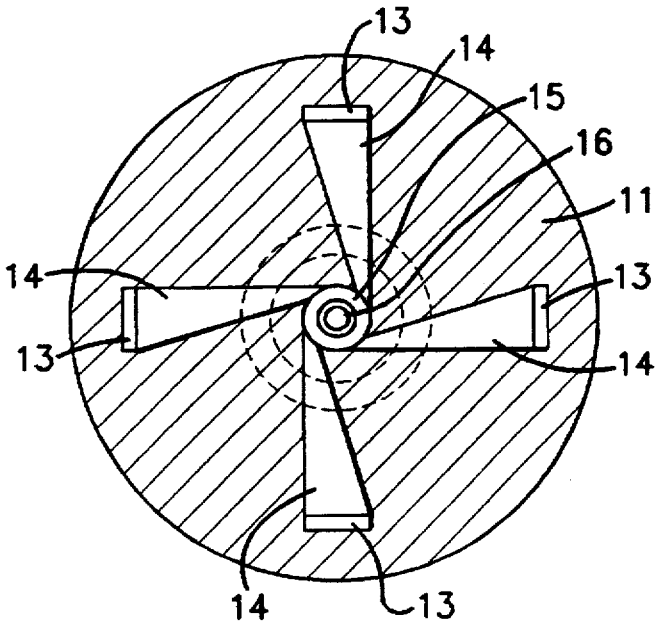
FIG. 6 is a sectional view along sectional plane 6—6 of the nozzle sleeve of FIG. 5.
Figure 7:
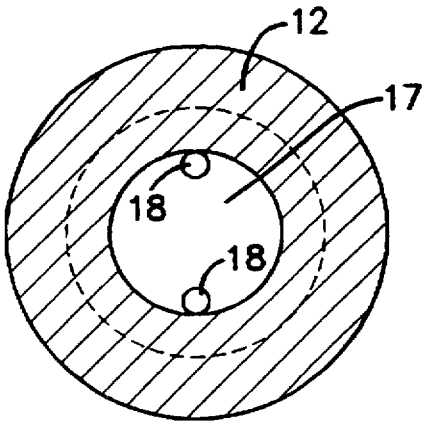
FIG. 7 is a sectional view along sectional plane 6—6 of the nozzle core of FIG. 5.

FIG. 5 shows another embodiment of a nozzle unit consisting of a nozzle sleeve 11 and nozzle core 12 to be used especially for fuels where the nozzle unit must be adapted precisely to the fuel oil viscosity, as in the instance of heavy fuel oils. Changes would have to be introduced in the supply channels 5, the tangential channels 6 and the mixing chamber 3 of nozzle core 2 as well as in the expansion chamber 7 of nozzle sleeve 1 if the nozzle unit of FIG. 1 had to be adapted to a viscosity of more than ten centipoises. The changes are simpler in the embodiment according to FIG. 5. In this embodiment, supply channels 7 and tangential channels 14 are located in the nozzle sleeve 11, the tangential channels 14 opening into the compression chamber 15 which has the nozzle channel 16. The air is conveyed to the mixing chamber 17 via bores 8, while this chamber is connected to the compression chamber 15. It will suffice to use a deeper mixing chamber 17 in the nozzle core 12 and to enlarge the diameters of the bores in order to adapt this nozzle unit to a higher viscosity.

Figure 8:
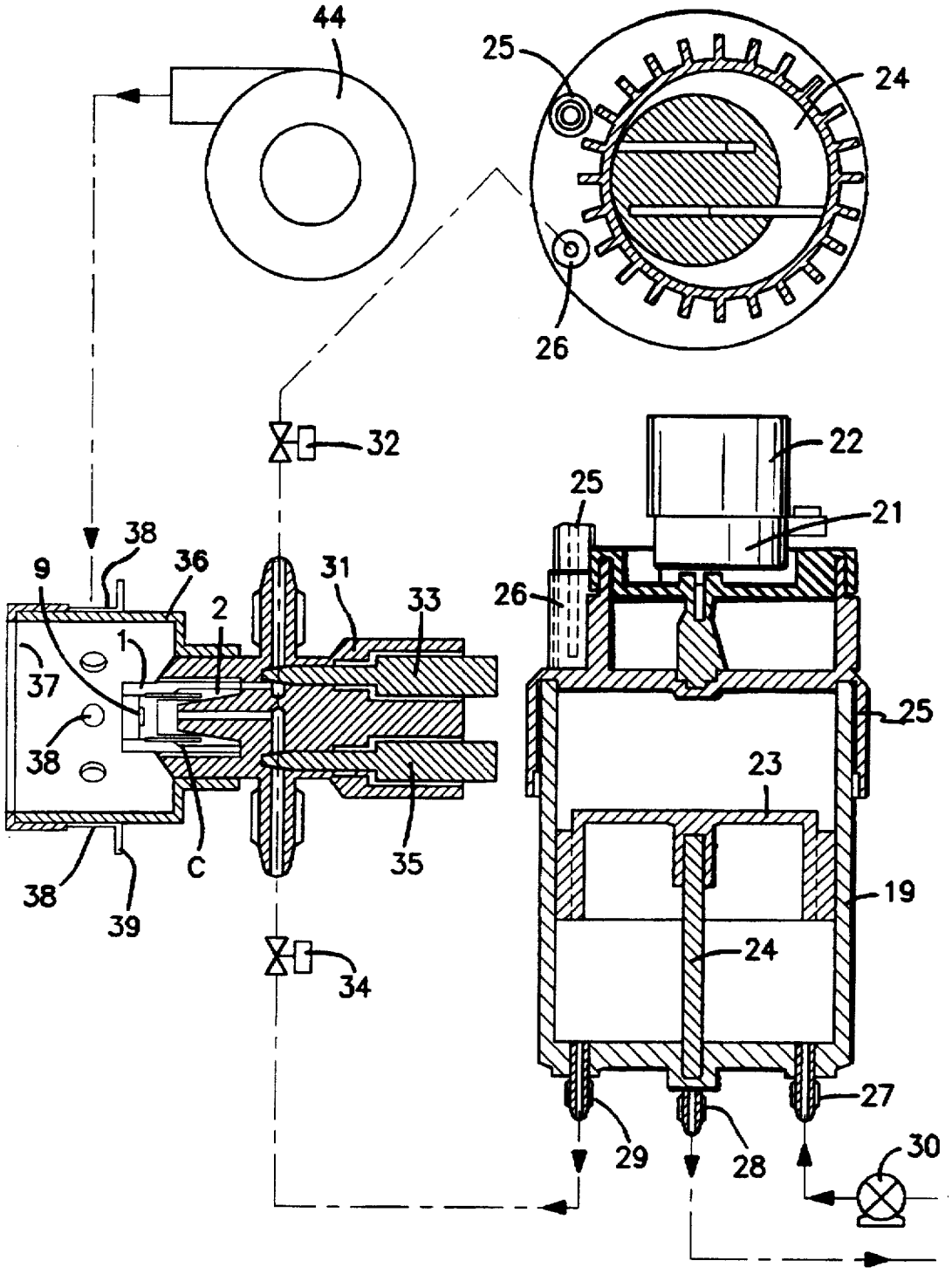
FIG. 8 is a schematic representation of the operating principle of the apparatus according to the invention.

FIG. 8 shows the operating principle of the device according to the present invention. A pressure vessel 19, preferentially made of duroplast, is tightly sealed with a lid 20 supporting a rotary piston compressor 21 driven by a motor 22. A float 23 with needle 24 is inside the pressure vessel 19. Lid 20 is provided with a relief pressure valve 25 and air vent 26. A fuel oil inlet 27, a fuel oil return pass 28 closed off by the needle 24 temporarily, and a fuel oil vent 29 are located at the bottom of pressure vessel 19. The fuel oil (not shown) is conveyed into pressure vessel 19 via a pump 30 while the compressor 21 creates air pressure in the pressure vessel 19 the pressure level being adjustable via the relief pressure valve 25. Excessive filling of the pressure vessel 19 is avoided by the float 23 pulling needle 24 from the return pass 28 as soon as a predetermined amount of fuel oil is present in pressure vessel 19 hence excess fuel oil flows back to the intake duct of pump 30. The nozzle sleeve 1 (11) with nozzle core 2 (12) is inserted into a manifold 31. This manifold is supplied with compressed air via air vent 26 and a magnetic valve 32, the air volume being adjustable with a needle valve. The fuel oil, which is under the same pressure as the air, is forced into manifold 31 via the fuel oil vent 29 and a magnetic valve 34, the fuel oil volume being adjustable with a needle valve 35. The manifold 31 supports a hollow combustion cylinder 36 provided with a screen 37 in the direction of the nozzle axis and having lateral holes 38 which can be closed off to varying degrees with a slide 39. Secondary air of combustion coming from a blower 40 can be introduced through these lateral holes 38 into the hollow cylinder 36 and thus into the vaporized fuel oil that is already enriched with primary air of combustion.

Compressed air will flow as described into the mixing chamber 3 (17) of nozzle core 2 (12) after opening of the magnetic valve 32 and purge the nozzle channel 9 (16), so that the vaporized fuel oil after opening of the magnetic valve 34 can leave through a "clean" nozzle channel 9(16) and be ignited in the form of a fuel oil-air mixture when mixed with the compressed air coming from the pressure vessel 19.

For full combustion of any CO that might be present, it will be possible to heat screen 37 to about 750° C. so that the CO (which burns to $CO_2$ at 700° C.) is eliminated from the residues.

Since $NO_x$ will decompose to nitrogen and oxygen at 620° C., this can be attained with screen 37.

When it is desired to terminate the combustion process, the magnetic valve 34 is closed first, then only compressed air will pass through nozzle channel 9(16), thus purging it from fuel oil residues.

The relief pressure valve 25 may consist of a membrane raised by a magnet core in an electrical coil when a preselected current flows, at which point the excess pressure is relieved. Such an embodiment when provided with a potentiometer controlling the coil current greatly facilitates adjustment of the pressure level, since a mere change of the current through the coil is required in order to raise or lower the membrane's pressure resistance. It is an important advantage of this solution that the fuel oil flow in unit time can be adjusted continuously via the pressure in pressure vessel 19 while there will be no important change in particle size.

In practice the particle size decreases by about 0.5 microns when the pressure is raised from 1 to 4 bars, while the amount of fuel oil delivered increases from 0.5 to about 1.1 kg/hour at these values of pressure. This provides a possibility for continuous adaptation of the hourly consumption to the weather conditions, e.g., via an external thermostat, so that the time required for combustion can be shortened by raising the amount of fuel oil burned per unit time, which occurs in an automatic fashion through an electronic circuit.

Figure 9:
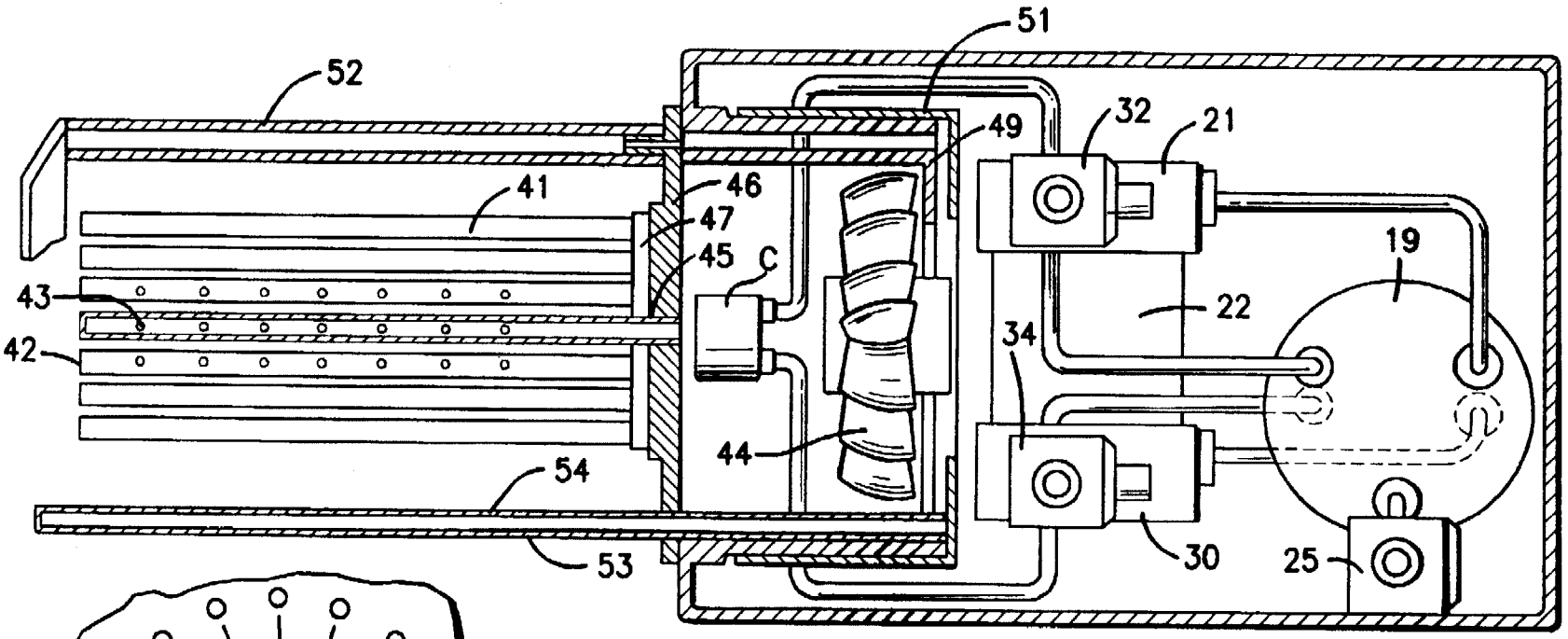
FIG. 9 is a partly sectional top view of an extremely advantageous embodiment of the apparatus according to the invention.

FIG. 9 shows an extremely advantageous embodiment of the device according to the present invention while disregarding any considerations of scale. The main difference relative to the device of FIG. 8 are the nine pipes 41 replacing, in this embodiment, the hollow cylinder 36; the free ends 42 of said pipes are closed off. The pipes 41 have bores 43; a blower 44 supplies compressed air to pipes 41 which is blown into a flame (not shown) through these bores 43. The blow direction of bores 43 can be adjusted in any desired way through a thread 45 allowing the pipes 41 to be screwed into a distributor plate 46, where they can be locked in position by nuts 47, i.e., the air coming from blower 44 can be blown into the flame in the direction of its axis or more or less tangentially to it so that a controlled vorticity can be attained. It is also possible to achieve a combination of axial and tangential blowing. Further, bores 43 of one pipe 41 can be staggered relative to those of another pipe 41.

Two possibilities for fume recirculation are shown in FIG. 9. The body 49 of blower 44 has openings 50 screened from the outside air with a sleeve 51. In one version, the blower draws fumes via a double-walled hollow cylinder 52 and openings 50; together with outside air drawn in by the blower 41, these fumes are then blown by the blower 44 via pipes 41 into the flame (not shown).

Figure 10:
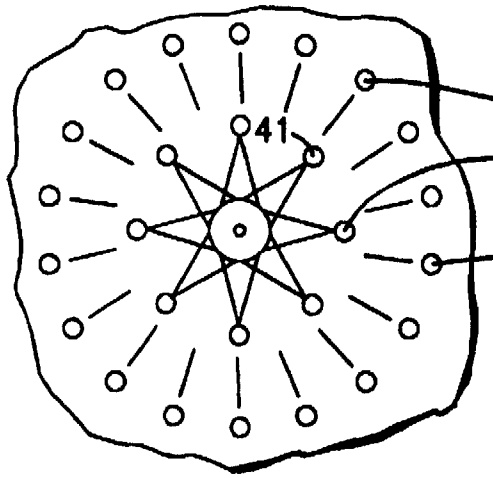
FIG. 10 is a schematic front view of the apparatus of FIG. 9 showing the distribution of secondary air of combustion and a possible recirculation of the fumes.

In the other version, which is indicated schematically in FIG. 10, the fumes are drawn in via external pipes 53 provided with bores 54 and via the openings 50 of the body 49, and then blown into the flame as described.

It was shown experimentally that the flame is chilled by secondary air of combustion when this is introduced upstream and parallel to the flame axis, thus the thermal vaporization of the fuel oil is diminished and a maximum combustion prevented.

When secondary air of combustion is introduced via pipes 41 as proposed by the present invention, the advantage arises that the cold external air coming from blower 44 is heated up in pipes 41 and hence cannot chill the flame, thus incomplete combustion on account of chilling of the flame, and consequently a lower thermal vaporization of the fuel oil, is avoided.

With secondary air of combustion blown in a direction perpendicular to the flame, it is further possible to shorten the flame, hence the burner volume can be kept small and the heating efficiency increases, particularly so since the ultrafine fuel oil particles generated by nozzle 1 of the present invention will burn very rapidly and need not be kept suspended, as described, by an overly large volume of secondary air of combustion.

It should be stressed here that the diameter of nozzle channels 9 and 16 is at least 0.4 mm, hence these channels will practically never clog, already since nozzle 1 (11) is purged before and after the combustion process. Despite this width of nozzle channels 9and 16 (their cross sections being about seven times larger than those of mechanical spray nozzles), the consumption can be maintained at 0.5 kg/hour, merely an increase in air pressure in the pressure vessel 19 will raise this consumption in a continuous fashion up to 1.1 kg/hour.

In view of these low amounts of fuel oil burned in unit time, a very large market segment so far not properly served can be covered.

I claim:

1. Apparatus for the vaporization of fuels and supply of air for combustion comprising a nozzle unit (C) supplied via a fuel pump (30) and fuel supply line (29) with fuel and, separately, via an air generator (21) and air supply line with air, said nozzle unit (C) having a longitudinal axis and a chamber mounted perpendicularly to said axis into which the fuel and air are conveyed via supply channels for mixing, said supply channels (6, 14) for the fuel opening tangentially into the chamber so that the fuel is set in whirling motion occurring substantially in a direction perpendicular to the longitudinal axis, the mixture being discharged from the nozzle unit via a nozzle channel (9, 16), said apparatus being characterized by the fact that the separate supply channels (4, 18) for the air in the nozzle unit (C) are formed by bores running parallel to the longitudinal axis so that the air is pressed into the fuel whirling in a first chamber part (3, 15) of the chamber, in a direction substantially perpendicular to the plane of rotation of this fuel; that the chamber comprises a second chamber part (7, 17) where the air and mixture can expand and which is located axially next to the first chamber part (3, 15); and that directly upstream in front of the nozzle channel (9, 16) the chamber has a compression part (8, 15) where the mixture is compressed prior to being ejected through the nozzle channel (9, 16) and which has a smaller diameter than the second chamber part (7, 17), the mixture after being ejected from the nozzle channel (9, 16) undergoing expansion as if exploding and hence shattering the fuel into minute droplets.

2. Apparatus according to claim 1, characterized in that the supply channels (6, 14) for the fuel in the nozzle unit decrease in width from (radially) outside toward (radially) inside.

3. Apparatus according to claim 1, characterized in that the nozzle unit (C) consists of a nozzle sleeve (1, 11) and a nozzle core (2, 12), the compression chamber part (8, 15) and the nozzle channel (9, 16) being disposed within the nozzle sleeve (1, 11) and said bores (4, 18) being disposed in the nozzle core (2, 12).

4. Apparatus according to claim 3, characterized in that the first chamber part is constituted by the compression chamber part (15), that the supply channels (14) for the fuel are disposed within the nozzle sleeve (11), and that the second chamber part (17) is disposed within the nozzle core (12).

5. Apparatus according to claim 3, characterized in that the supply channels (14) for the fuel and the first chamber part (3) are disposed within the nozzle core (2) and that the second chamber part (7) is located in the nozzle sleeve (1).

6. Apparatus according to claim 1, characterized in that the axial depth of the second chamber (3, 17) and/or the diameter of the bores (4, 18) can be varied in relation to the fuel viscosity.

7. Apparatus according to claim 1, characterized in that the fuel and air are pressed into the nozzle unit (C) while being under identical pressures.

8. Apparatus according to claim 1, characterized in that a compressor (21) generates air pressure inside a pressure vessel (19) into which fuel is placed by means of a fuel pump (30), this air pressure being adjustable via a regulator (25); that means (23, 24) are provided in the pressure vessel (19) by which an excessive filling of the pressure vessel (19) with fuel can be avoided; that fuel and compressed air are conveyed via magnetic valves (32, 34) from the pressure vessel (19) into the nozzle unit (C) situated in a manifold (31); that this compressed air constitutes part of the air of combustion; and that means are provided to blow additional air of combustion from a blower (40, 44) into a flame.

9. Apparatus according to claim 8, characterized in that a hollow cylinder (36), connected with the nozzle unit is provided with lateral holes (38) the cross sections of which can be varied with a slide (39) in order to adjust the amount of additional air of combustion.

10. Apparatus according to claim 8, characterized in that the additional air of combustion is blown into the flame in a direction perpendicular to the flame through pipes (41) having bores (43), the free ends (42) of the pipes being closed off.

11. Apparatus according to claim 10, characterized in that means (52, 54) are provided through which fumes are drawn in by a blower (44) which are then blown into the flame through pipes (41) after being mixed with external air that has been drawn in.

12. Apparatus according to claim 8, characterized in that the blower (44) is an axial-flow blower.

13. Apparatus according to claim 8, characterized in that the regulator (25) of the pressure vessel (19) can be controlled electrically.

14. Apparatus according to claim 8, characterized in that downstream from the nozzle unit (C) a screen (37) is provided which can be heated electrically to a temperature of substantially 750° C.

* * * * *